US005513959A

United States Patent [19]

Mabillot et al.

[11] Patent Number: 5,513,959

[45] Date of Patent: May 7, 1996

[54] VALVE FOR PUMP WITH PRIMING CIRCUIT

[75] Inventors: Christian Mabillot; Jean-Francois Fragnet, both of Chateau-roux, France

[73] Assignee: KSB S.A., Courbevoie, France

[21] Appl. No.: 289,171

[22] Filed: Jul. 14, 1994

[30] Foreign Application Priority Data

Jan. 14, 1992 [FR] France ..... 92 00303

[51] Int. Cl.[6] ..... F04B 49/00

[52] U.S. Cl. ..... 417/299; 417/309; 417/435; 415/56.5; 415/56.6; 137/521

[58] Field of Search ..... 417/279, 299, 417/309, 435; 415/56.5, 56.6; 137/521, 855

[56] References Cited

U.S. PATENT DOCUMENTS

| | | | |
|---|---|---|---|
| 2,442,135 | 5/1948 | Longnecker et al. | 415/56.5 |
| 2,864,394 | 12/1958 | Hempel | 137/521 |
| 3,606,588 | 4/1969 | Romerhaus | 417/299 |
| 4,193,424 | 3/1980 | Hrabal | 137/855 |
| 4,684,333 | 8/1987 | Hirakawa et al. | 417/299 |

FOREIGN PATENT DOCUMENTS

| | | | |
|---|---|---|---|
| 1057609 | 3/1954 | France . | |
| 174085 | 1/1905 | Germany . | |
| 222761 | 2/1909 | Germany . | |
| 2260520 | 6/1973 | Germany . | |
| 115376 | 9/1975 | Germany . | |
| 2409331 | 9/1975 | Germany . | |
| 2625057 | 2/1977 | Germany . | |
| 61372 | 4/1983 | Japan | 137/855 |
| 81026 | 5/1919 | Switzerland | 415/56.5 |
| 1021819 | 6/1983 | U.S.S.R. | 417/435 |

*Primary Examiner*—Richard A. Bertsch
*Assistant Examiner*—Ted Kim
*Attorney, Agent, or Firm*—Darby & Darby

[57] ABSTRACT

A pump with a priming circuit containing a valve having a seating with an orifice and an obturator mounted so as to be able to be applied onto the seating in front of the orifice, where the obturator is a resilient blade embedded on one side to the seating. The flexibility of the blade increases from the embedded side to the other. An L-shaped member protrudes from an outer curvilinear wall of a priming element fixed onto the pump. The L-shaped member allows for the seating to be slide into a groove space. The obturator has two holes so that the obturator can be embedded onto the seat by mating with two projections from the seating surface.

8 Claims, 2 Drawing Sheets

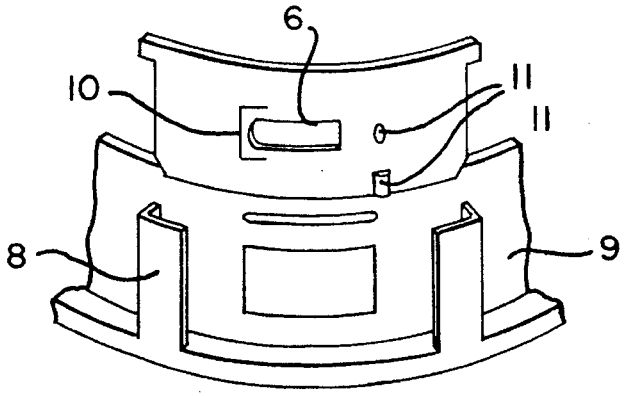
FIG. 3
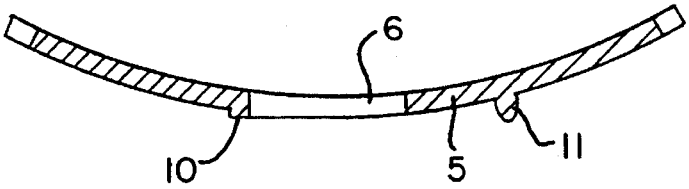
FIG. 4
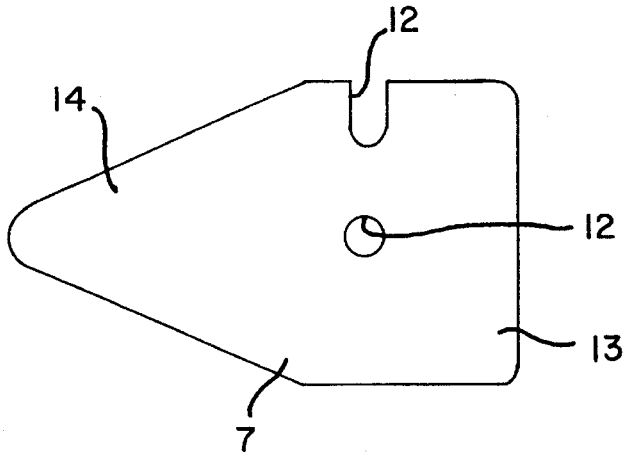
FIG. 5
FIG. 6
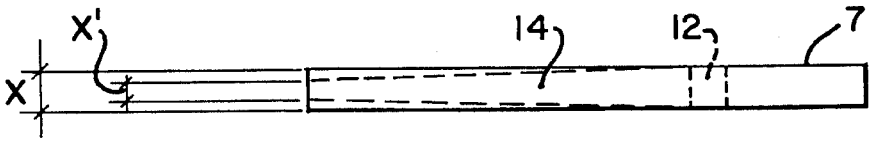

VALVE FOR PUMP WITH PRIMING CIRCUIT

BACKGROUND OF THE INVENTION

This invention pertains to valves that can be used in the priming circuit of a pump.

It is familiar for pumps to have a valve which, when open, permits an internal circulation between the output and the intake. The water is projected into the intake inlet of the first wheel and brings with it a part of the air from the intake chamber. A depression is created in the intake and the water rises in the pipes. The water loaded with air arrives in the output chamber where the settling occurs. The settled water returns to the intake, passing through the valve, and the cycle begins again. The water rises gradually in the intake pipes as the air is eliminated. When the air is completely evacuated, the water completely fills the pump and the rise in pressure causes the valve to close. The pump is thus primed.

A pump of this sort with an automatic priming circuit, includes the valve having a pull-back spring. This spring is a mechanical piece whose spacial dimensions can be thoroughly mastered. But the pull-back spring is in the passage of the liquid, which necessitates frequent cleanings. Another pump with an automatic priming system has a valve with a bendable rubber tube. This direct-passage valve not necessitate cleaning; but the rubber tube ages over time, such that its mechanical characteristics become uncertain.

German document DE-C-222 761 discloses a pump with priming circuit containing a valve with a seating (6) that has an orifice and an obturator mounted so as to be able to be applied onto the seating in front of the orifice, the obturator is an elastic blade embedded on one side. The valve is fixed directly onto the interior of the body of the pump and acts on a second opposite element. This arrangement is not economical for a pump addressed by the invention.

SUMMARY OF THE INVENTION

The present invention remedies the problems of the pumps containing a prior valve by utilizing a new valve that retains the advantages of the prior valves.

The present invention addresses a pump with priming circuit that has a valve, the seating of which is threaded slid axially into a groove located on a priming element fixed onto the body of the pump. This valve contains a seating that has an orifice and an obturator mounted so as to be able to be applied onto the seating in front of the orifice. The obturator is an elastic blade embedded on one side, the flexibility of which increases from the embedded side to the opposite end, which is known, for example, from document DE-C-174 085.

Only by providing for an resilient blade that obeys the aforementioned law of flexibility can the reliability of the automatic priming circuit be insured. The resilient of the elastic blade, specifically made of metal, does not age. Nor does it necessitate frequent cleanings.

To obtain the law of flexibility indicated above, the width of the blade and/or its thickness can diminish from the embedded side to the opposite end.

The operation is more reliable when there is a heel coming out of the edge of the orifice farthest from the embedded side and protruding toward the blade.

In the attached drawing, given purely as an example:

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 3 is an exploded perspective view illustrating the mounting of the seating of the valve according to the invention;

FIG. 4 is a longitudinal cross-section view of the seating of the valve according to the invention; and FIG. 5 is a plane view of it; and FIG. 6 is a longitudinal cross-section view of the blade according to the present invention.

Figure 1:
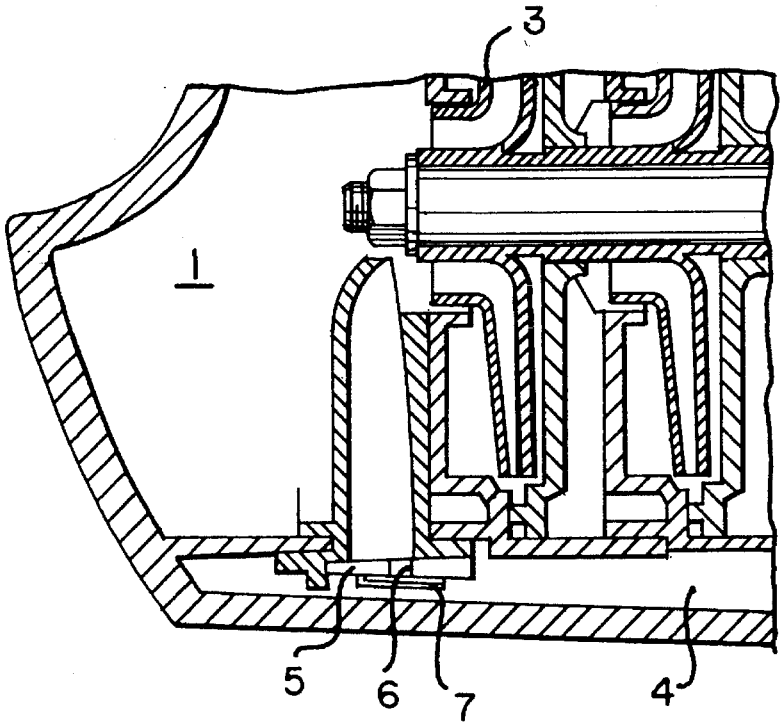
FIG. 1 is a partial cross-section view of a pump according to the invention.
Figure 2:
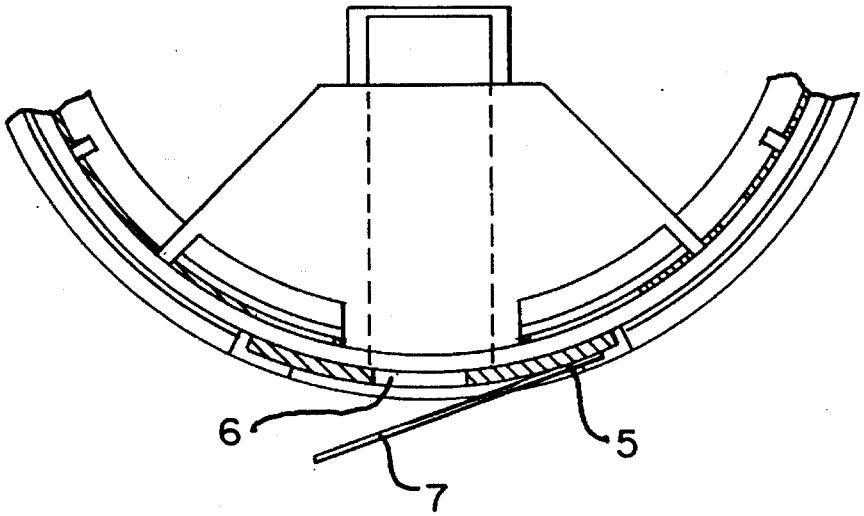
FIG. 2 is a partial cross-section view of a part of the priming circuit of the pump in FIG. 1.

The pump depicted in FIG. 1 has an intake chamber 1 that communicates with an output chamber 2, not shown, through a cellular pump body 3. The intake chamber 1 can also communicate with the output chamber by a priming circuit 4 that can be closed by a valve that has a seating 5 pierced by an orifice 6 and an resilient blade 7.

Member 8 is an L-shaped member protruding from element 9 and defines a groove space between the distal leg of the L-shaped element 8 and element 9.

The seating is mounted on the pump body by being axially slid into a groove 8 located on a priming element 9 of the pump body. The seating 5 is shaped like the arc of a circle. The orifice 6 is longitudinal in shape and is edged, on the side opposite the side where the blade 7 is embedded, by a heel 10 that protrudes toward the blade 7. On the other side of the orifice 6, the seating 5 has two projections 11 that cooperate (i.e., mate) with two holes 12 in the blade, so as to embed it.

The blade 7 is comprised of a roughly rectangular part 13 intended for embedding it, part 13 in which there are holes 12, and a part 14 shaped like an isosceles triangle, the base of which is coupled to one side of part 13. Because the width of part 14 decreases as it extends away from the embedded part 13, the flexibility of the part 14 increases.

We claim:

1. A pump with a priming circuit containing a valve having a seating with an orifice and an obturator mounted so as to be able to be applied onto the seating in front of said orifice, said obturator being a resilient to said seating on one side, of said seating, the flexibility of the resilient blade increasing from the embedded side to an opposite side wherein an L-shaped member protrudes outwardly from an outer curvilinear wall of a priming element fixed onto the body of the pump, the L-shaped member defines a groove space between a distal leg of the L-shaped element and the priming element, and the seating is slidably received in the groove space.

2. A pump according to claim 1, wherein the width of the blade decreases from the embedded side to the opposite end.

3. A pump according to claim 2, wherein the blade has a triangular part.

4. A pump according to claim 1 wherein the thickness of the blade decreases from the embedded side to the opposite end.

5. A pump according to claim 1, having two projections in the seating that mate with two holes in the blade which are situated closer to the opposite side than to the free end.

6. A pump according to claim 1, having a heel coming out of the edge of the orifice farthest from the embedded side and protruding toward the blade.

7. A pump according to claim 1, wherein the seating is shaped like the arc of a circle.

8. A pump according to claim 1, wherein said priming element has an axis and the seating is slid axially into the groove space.

* * * * *